US005409230A

United States Patent [19]

Dunaway et al.

[11] Patent Number: 5,409,230

[45] Date of Patent: Apr. 25, 1995

[54] BOOTH FOR PRACTICING GOLF INDOORS

[75] Inventors: David R. Dunaway; Marvin R. Dunaway, both of Boulder; Robert L. Bromley, Louisville, all of Colo.

[73] Assignee: Par 6 Originals, Incorporated, Louisville, Colo.

[21] Appl. No.: 9,466

[22] Filed: Jan. 26, 1993

[51] Int. Cl.[6] ..... A63B 69/36

[52] U.S. Cl. ..... 273/176 F; 273/181 F; 273/181 B; 273/35 B

[58] Field of Search ..... 273/410, 181 F, 26 A, 273/181 R, 181 D, 181 A, 35, 176

[56] References Cited

U.S. PATENT DOCUMENTS

| | | | |
|---|---|---|---|
| 610,336 | 9/1898 | White | 273/176 B |
| 1,262,314 | 4/1918 | Downey | 273/181 R |
| 1,540,670 | 6/1925 | Vidmar | 273/410 |
| 1,656,718 | 1/1928 | Bickford | 273/410 |
| 1,669,640 | 5/1928 | Warlick . | |
| 2,329,992 | 9/1943 | King | 273/181 D |
| 2,397,921 | 4/1946 | Cole | 273/410 |
| 2,823,034 | 2/1958 | Bimgham | 273/26 A |
| 2,827,297 | 3/1958 | Foster | 273/410 |
| 2,922,653 | 1/1960 | O'Brien | 273/410 |
| 3,222,067 | 12/1965 | Litwhiler | 273/26 A |
| 3,227,449 | 1/1966 | Schwab | 273/181 F |
| 3,558,140 | 1/1971 | Romen | 273/410 |
| 4,381,110 | 4/1983 | Balaz | 273/181 F |
| 4,703,931 | 11/1987 | Steen | 273/26 A |
| 4,815,736 | 3/1989 | Wright | 273/26 A |
| 4,948,141 | 8/1990 | Neuman | 273/181 F |
| 5,007,645 | 4/1991 | Weigl . | |
| 5,026,060 | 6/1991 | Beeber . | |
| 5,088,740 | 2/1992 | Peterson | 273/26 A |
| 5,116,056 | 5/1992 | Schmutte . | |

FOREIGN PATENT DOCUMENTS

| | | | |
|---|---|---|---|
| 907045 | 3/1934 | United Kingdom | 273/181 F |

*Primary Examiner*—Mark S. Graham

[57] ABSTRACT

There are many constructions for permitting one to practice portions of the game of golf indoors. However golf requires a different types of strokes to be performed proficiently, and practicing all the types of strokes indoors, and in a sequence which simulates an actual golf game, has until now been problematic. Disclosed is a practice booth for golf with a putting pan which serves a number of functions. The pan itself retains the lower edges of net like walls of the booth, and gathers end supports these walls when the pan is hoisted by ropes or cables to the supporting roof of the room in which the booth is erected. The putting pan is made of bendable but ridged hollow sections which permit the upper surface to be warped to simulate variations in lies of putting greens. Alternative carpet like coverings are available to change the putting surface characteristics. A removable target for chipping or driving attaches to one net wall of the booth. The target is made of a foam elastomer slab which dents easily to mark the impact of the driven ball, but slowly restores to its original flat shape after a time.

6 Claims, 4 Drawing Sheets

BOOTH FOR PRACTICING GOLF INDOORS

BACKGROUND OF THE INVENTION

The invention relates to the field of indoor sports practice booths, and in particular indoor structures for practicing the game of golf.

The prior art is replete with examples of indoor erected structures or mechanisms to simulate outdoor conditions so that the user could practice playing golf. Such include a simple putting target which simulates a green and cup portion of a regular golf course so that the user can practice putting. More complex systems may include electronically or optically simulated images of fairways. These images can be changed to give the illusion of progressing through a round of golf, either on command of the player, or automatically in response to the force, direction, etc. of the driven ball as it strikes the surface on which the image of the fairway is displayed. Other systems, targets or structures for accomplishing various parts of the game of golf indoors are shown in the following United States patents:

610,336 (White) shows an indoor golf range which uses a series of closely spaced hands of rubber or leather strips or the like arranged in wall-like layers. The golf ball is struck towards the wall of strips which retards the flight of the ball.

1,540,670 (Vidmar) shows a tent like arrangement of nets supported by poles. A canvas target with a black strip is shown against the end net wall. The black strip is intended to help the driven golf ball show up against the black background.

1,656,718 (Bickford) teaches the use of rigid walls arranged in an overall hopper shape to funnel the driven balls for a controlled return, and hopefully avoid rebound of the balls back towards the user.

1,669,640 (Warlick) shows a sloping fairway and green arrangement, complete with "water hazard", together with net or mesh walls 33 suspended from above by lines 35.

2,827,297 (Foster) shows a folding target with a series of concentric overlapping holes in a series of overlapping sheets of cloth, plastic etc.

2,922,653 (O'Brien) shows a series of nets arranged on beams and poles which form the sides, top, and target provided at the end of a golf practice booth.

3,558,140 (Romeo) teaches the combination of a vertically arranged target for practicing drives or approach shots, and below this a simulated green surface which is intended to receive the driven balls, after the ball falls from the target into a trough. The ball can then be putted into one of several cups formed in the simulated green.

5,007,645 (Weigl) shows a golf practice device for use in a garage, which comprises a net mounted on the garage door via brackets. These brackets are mounted to hold the net during use and storage.

5,026,060 (Beeber) shows a series of indoor golf playing areas. A driven golf ball strikes one of a series of troughs erected in front of the driving range portion. Each trough is connected to a conveying tube which deposits the driven ball in one of the selected playing areas, where the user must chip or putt, depending on where the ball is directed by the conveying tube.

5,116,056 (Schmutte) shows a track supported net arrayed like a curtain around an interior comer of an indoor space, The net is gathered in a bunch or roll at the bottom to help trap the driven ball, None of these patents disclose a system which is compact, versatile such that all aspects of golf can be practiced, yet permit the entire system to be quickly stored or deployed so that the indoor space can have alternative uses.

OBJECTS OF THE INVENTION

Accordingly, it is an object of this invention to provide a golf practice booth which provides impact absorbing walls to permit the impact of a golf ball to be absorbed without damage to the surrounding structure, yet permit easy removal of the impact absorbing walls when the booth is not in use.

It is another object to provide a golf practice booth in which driving, chipping and putting can all be performed in a relatively small area. Thus, most combinations of types of strokes can be rehearsed in any chosen sequence.

SUMMARY OF THE INVENTION

The invention includes a series of suspended walls which include a target wall and flanking walls rising generally vertically above a supporting floor, a movable floor member, or putting pan, located between the walls and normally supported by the supporting floor, and means for removing the movable floor member from the supporting floor, and means for interengaging the walls and the floor whereby when the floor member is removed, the walls are removed with it. In this manner, the booth can be removed from the floor The invention also includes a target for use in practicing certain strokes in the game of golf comprising a planar member suitable for positioning on a vertical support, such as a wall of a golf practice booth or the like, the planar member comprising a foamed polymer material capable of deforming in response to being impacted by a golf ball in flight, the deforming thereof being such that an impression of the impacting ball remains visible for a substantial period of time after the moment of impact, the foamed polymer material having resilient characteristics such that the impression eventually substantially disappears.

Further, the invention includes a movable floor comprising a flexible base, and a covering over the base for simulating a putting surface, and means for selectively flexing the base to form adjustable contours in the putting surface and the driving/chipping surface, whereby the user can control the lie and slope of the putt, and simulate various tee box or fairway circumstances.

Other aspects and advantages of the subject invention will be understood with reference to the disclosed preferred embodiment set forth in detail as follows.

DETAILED DESCRIPTION OF THE PREFERRED EMBODIMENT

Figure 1:
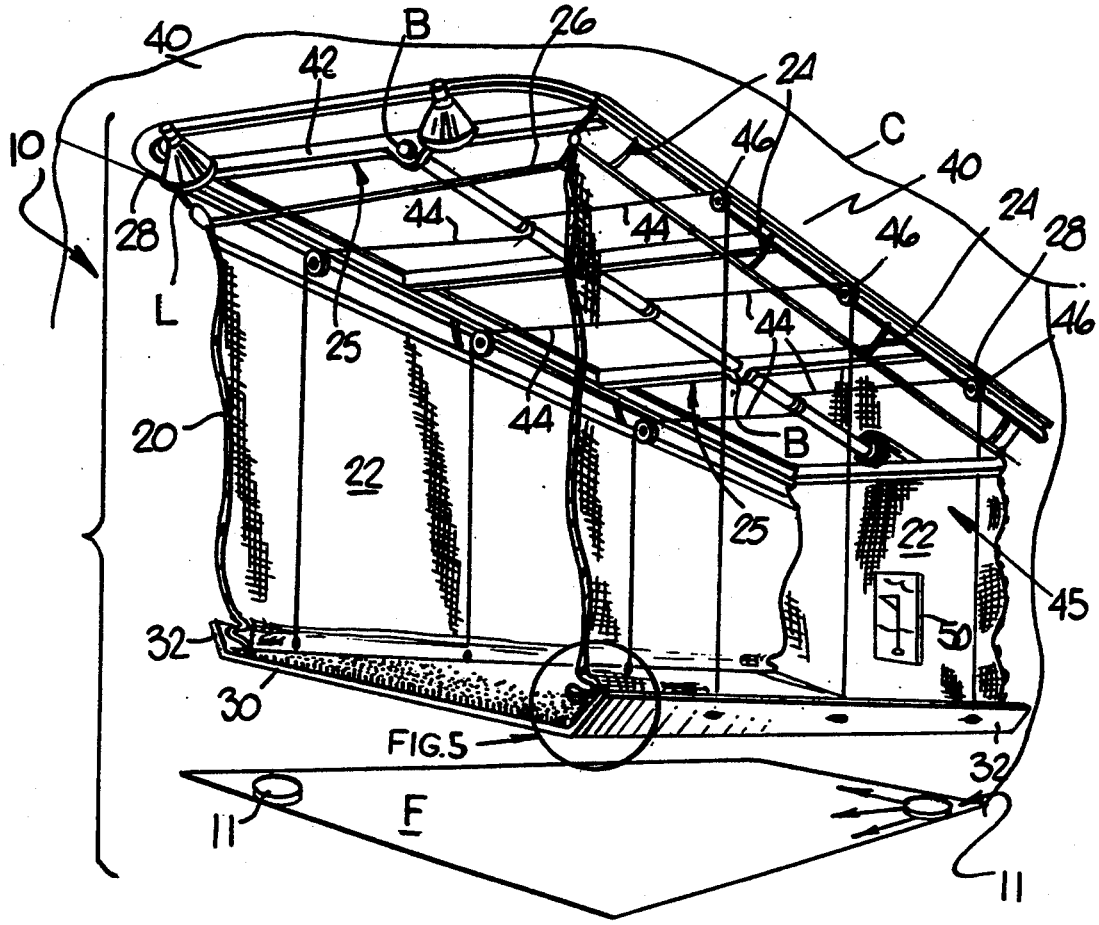
FIG. 1 is a perspective view of the practice booth in accordance with the invention.

Referring to the figures, the golf booth 16 comprises three main portions, a series of generally vertical walls 20, a movable floor or putting chipping or driving pan 30, (hereinafter referred to as the putting pan 30) below the walls, end a system 48 for raising the walls and movable putting pan so that all are suspended above the floor F of the room in which the booth is erected. While the booth 10 can be be used in a garage of a conventional house, it can also be used in any space of adequate size, and unless auxiliary supports are provided to support the raising system, the space should have a roof or ceiling C structure strong enough to support the full weight of the entire booth structure. These parameters will be detailed below. In any event, the inventive device could be used in any room or space adequate to support the roof and sized to accommodate the booth and the swinging of a golf club, such as a spare room, basement, commercial retail building or office building or the like.

The raising system 40 preferably has a central axle 42 mounted above and along the central axis of the booth. The axle is powered by a conventional electric motor 45, preferably mounted to the ceiling C. The central axle 42 can in turn be mounted to the ceiling by bearings B carried by laterally extending braces 25 arranged periodically along the shaft 42 and extending to the rails 28.

Pairs of hoisting cables 44 and 44 are affixed to the axle at spaced points along the length of the booth at each lateral side. Each cable extends outwardly near the roof of the supporting room to their respective sheaves or reliefs 46 As will be detailed, the sheaves or rollers, and the wall supporting lines 24 are attached to support channel or track 28 along each side of the booth. Each cable 44 then continues down along the outside of the booth walls 22 to an attachment point along the outer edge of the the putting pan 30. The motor is mounted at the far end of the booth, behind the far wall 22. In this way the motor is far from the swing of the golf club during use of the the booth, and is protected from flying golf balls by the end wall 22.

The walls as shown are a series of open weave netting of conventional construction, normally used for indoor and outdoor sports practice cages and the like. Each wall 22 is attached to a side edge of the booth ceiling panel 26 which can be made of a similar net of mesh material. At frequent intervals along the seam at the intersection of the wall and ceiling panel are the wall support lines 24 which suspend the walls and ceiling panels from the extruded suspending channel or track 28 As seen in FIG. 1, the track 28 also supports adjustable lights L. Radiant heating elements can be conveniently supported along the track 28 where necessary. The walls and ceiling panel are thus held to form a generally rectangular net walled booth, which together with the putting pan, form five sides (three vertical walls, a ceiling panel and a putting pan) of the golf booth. Note that the lines extend away from the tracks (and thus away from any rigid supporting structure) so that the generally flaccid net of the walls and ceiling panel are in turn spaced away from such support structures or walls of the room containing the booth, and thus can yield and absorb the impact of a driven golf ball while insulating these rigid structures from the ball's impact.

Figure 2:
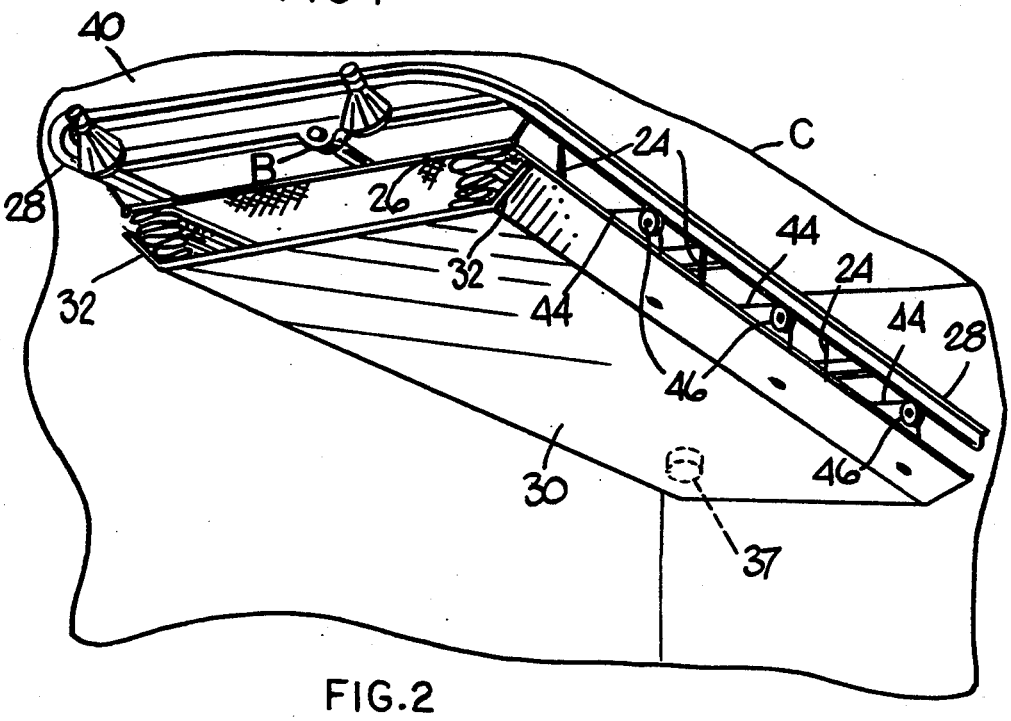
FIG. 2 is a perspective view of the booth of FIG. 1, but hoisted into a storage position.
Figure 3:
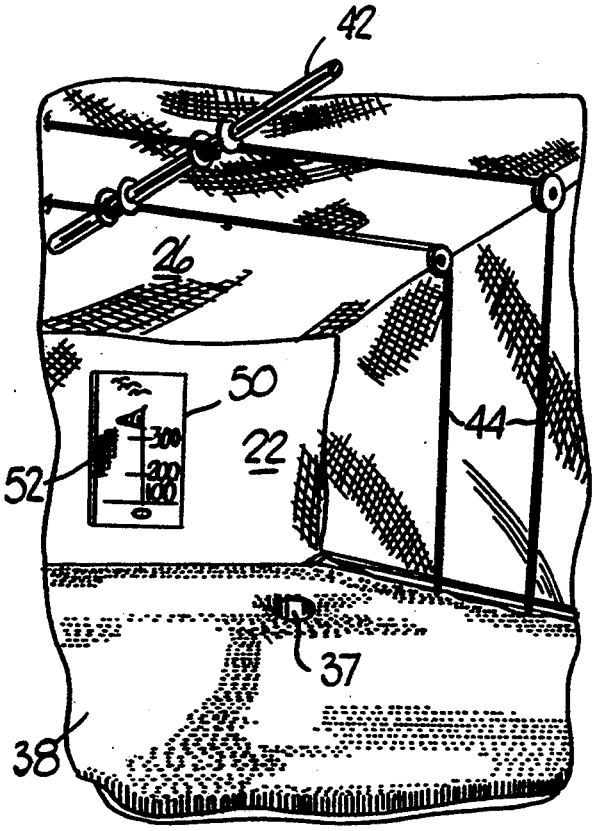
FIG. 3 shows a closer view of the interior of the booth of FIG. 1.
Figure 4:
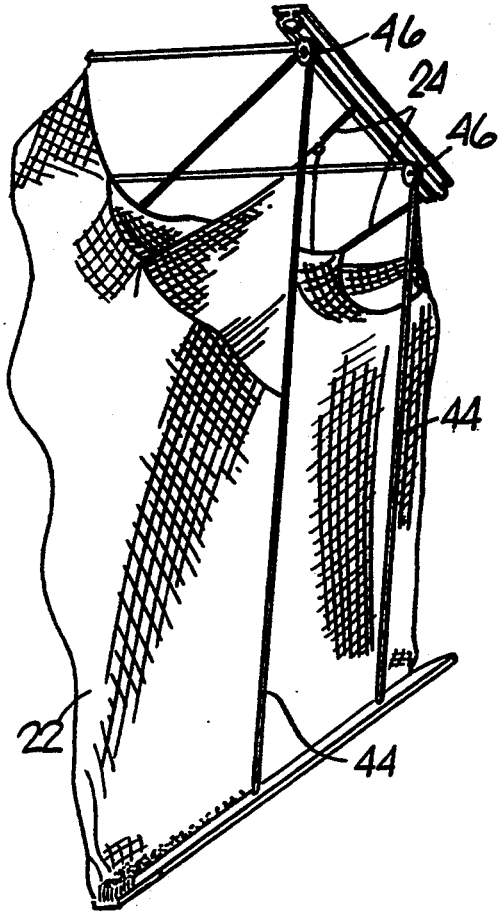
FIG. 4 shows another detail of FIG. 1.
Figure 5:
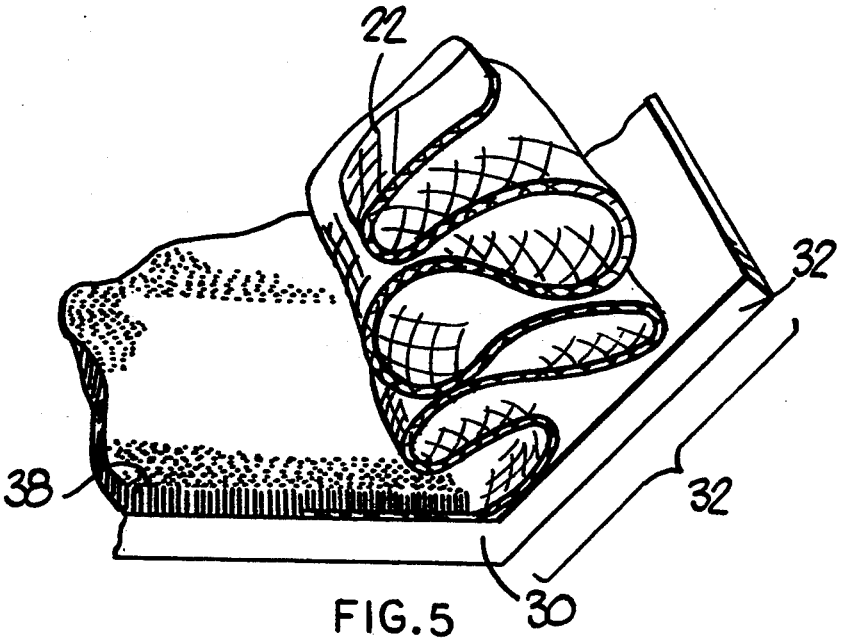
FIG. 5 shows a detail of the putting pan.
Figure 6:
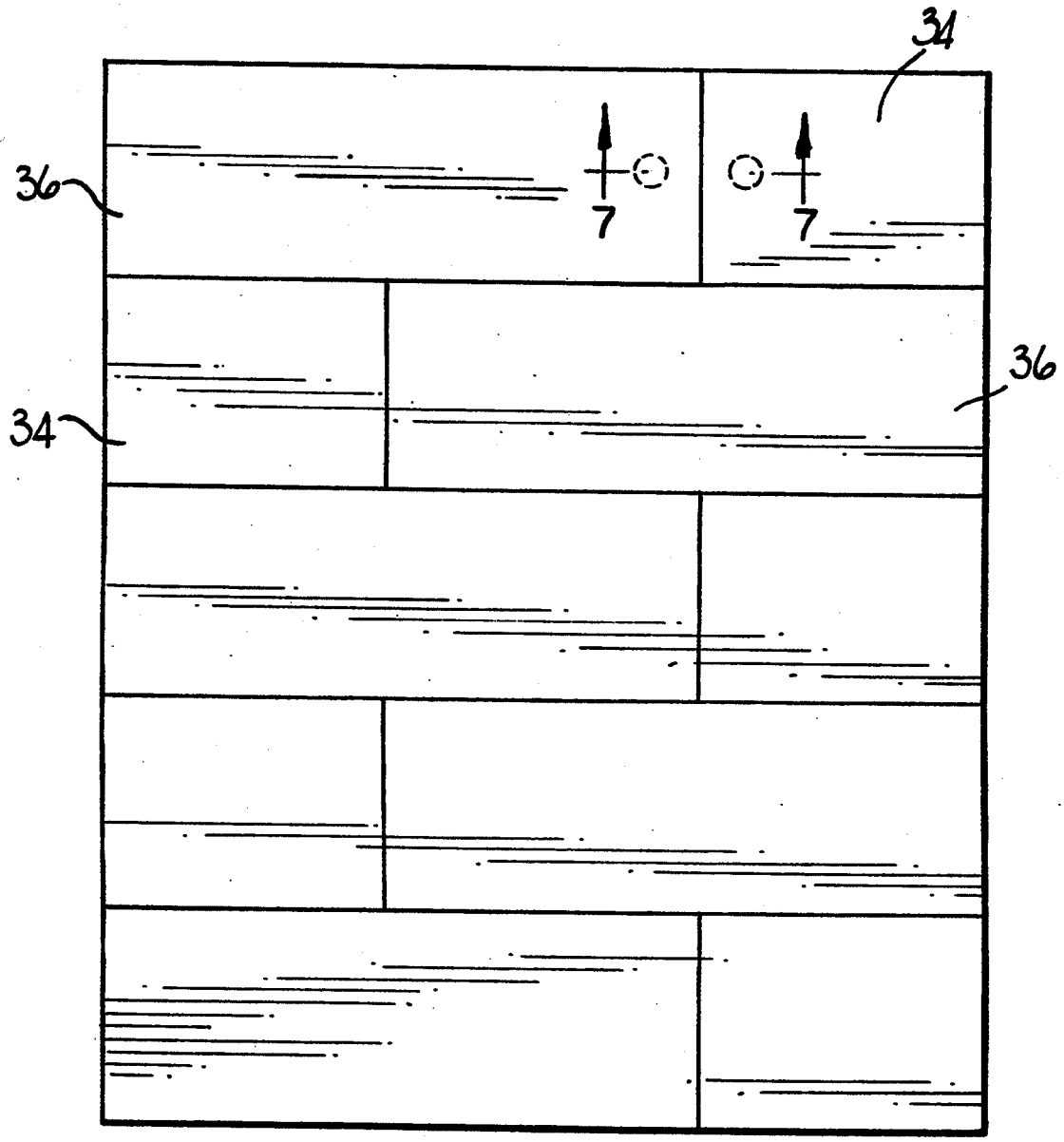
FIG. 6 is a view of the putting pan as seen from below.
Figure 7:
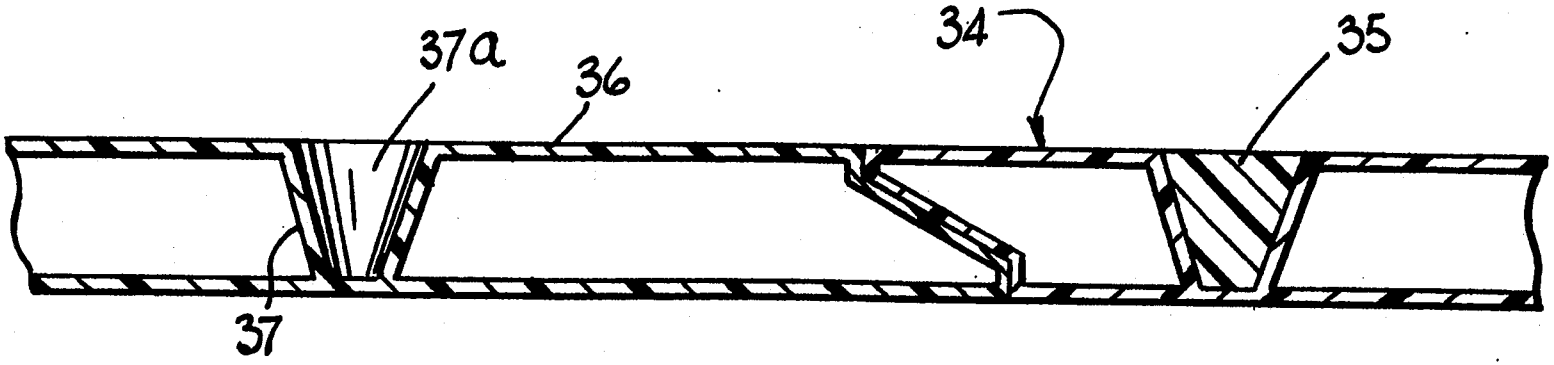
FIG. 7 shows a partial cross-sectional view of the putting pen taken along line 7—7 of FIG. 6.
Figure 8:
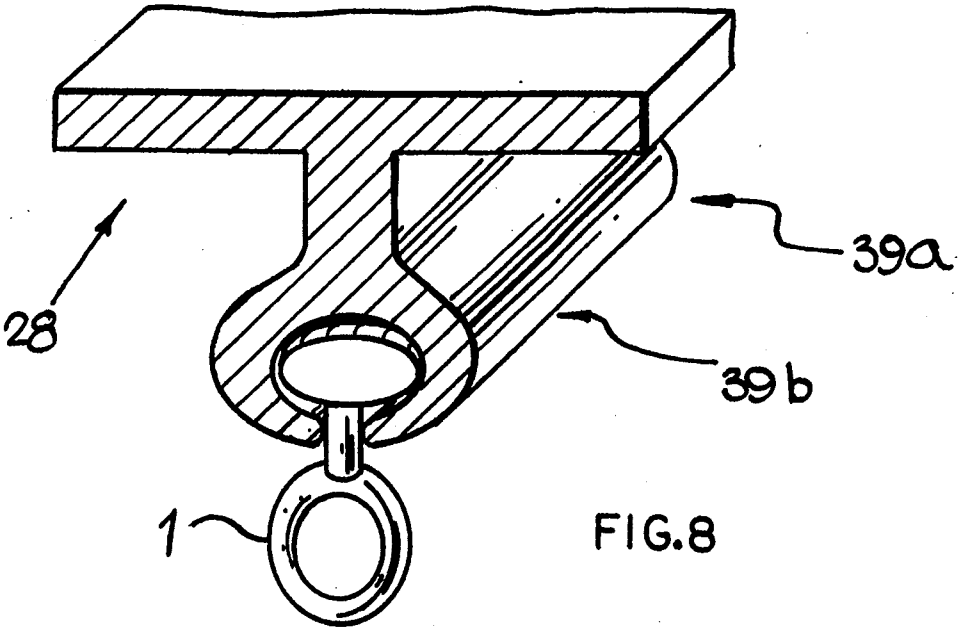
FIG. 8 shows a detail of the suspending track forming part of the practice booth suspending system.

The booth putting pan 30 has an overall rectangular shape, and except for the upwardly angled lip portions 32 along the side and back edges, the upper surface of the putting pan is generally flat, and except for the cup structure (shown in dash lines from the bottom of the pan in FIG. 2 and others) as will be detailed, generally featureless. The putting pan is preferably made up from a series of two basic floor modules for easier manufacturing and shipping. The width dimension of the putting pan is spanned by two such modules, a short module 34 and a long module 36. The entire putting pan is assembled from several such long and short pairs, alternately arrayed so that the joint between each long and short pair does not form a continuous break and thus weaken the ability of the putting pan to span the distance between the suspending cables when the booth is held above the supporting floor when not in use. The interlocking effect of the modules is shown in the plan view of the putting pan in FIG. 6. Each module is preferably made of a strong but light slab, preferably formed using conventional rotational molding techniques from low density polypropylene, or from a foam polymer core with structural skin on the upper and lower surfaces of the core. The overall thickness is such to glue adequate beam strength. Of course additional modules could be added to provide greater width, limited only by the strength of the materials used or the tolerance to bending or flexing which would occur when the pan would be raised by the previously described hoisting system.

The interlocking floor sections, once assembled become a generally unitary structure, and support the net walls, the putting green simulating carpet covering 38, and associated materials when hoisted above the room floor. The carpet covering could be replaced, or supplemented by a material which simulates driving or chipping conditions in the fairway or rough as well. Note the preferred upwardly projecting lip 32 around the periphery, together with the suspending cables 44 positioned outside of the actual booth interior but closely spaced and parallel to the the net walls 22, accumulate and trap the net walls as the pan is hoisted up by the cables 44. The lowermost edge of the walls is normally captured between the pan covering material 38, which holds the net and helps to absorb the impact of the ball and limit the travel of the net walls outwardly when impacted by the ball.

The mounting tracks or channels consist of a flange **39*a* through which penetrating fasteners attach the track to the supporting ceiling structure, and an open track 39*b*** in which slide several headed eye bolts I. These eye bolts can be located anywhere along the tracks so that various suspending lines, sheaves, even lighting fixtures can be adjustably positioned.

Alternately, the rails can consist of a generally continuous track or assembled track sections of generally circular cross-section. Such a track can itself support rollers by directly mounting the rollers around the track, and the lines 24 can be easily looped around spaced portions of the track to support and stabilize the upper corners of the booth.

The booth putting pan will now be detailed. As referred to above, the putting pan 30, once assembled has an upper layer or plate which is spaced a substantial distance from the lower plate. This gives the rigidity adequate to be suspended from the cables, but this thickness also permits one or more of the sections to have a molded in cup 37 for use as the goal in practice putting. As seen in cross section in FIG. 6–2 cup 37 has molded in cylinder sides 37*a* which extend to the lower plate. Another section is shown with a molded in cup, but this cup has a filler cylinder 35 positioned to eliminate this cup as a goal. It is envisioned that half of the sections will have a molded in cup, all but one or two of these cups will be filled with a filler cylinder 35. These cup features, together with the contouring function of the slope shims 11, provide desirable variations in putting surface conditions, which can be effected at the whim of the user.

The slope shims 11 consist of generally fiat topped wedges which can be arranged below predetermined portions of the booth putting pan on the supporting floor F while the booth is hoisted up and thus suspended above the supporting floor. They act to warp the putting pan when the putting pan is lowered to rest on the supporting floor and the slope shims 11. The resilient flexible nature of the booth putting pan, together with its natural weight, tend to let the putting pan naturally conform to the height variations of the shims. The resulting gentle, but significant, warping of the putting pan provides pleasing variations of the "lie" of the simulated green, and thus provides a varying challenge to the user. This, plus the ability of the user to change the location of the cup by merely trading the filling cylinders 35 among the molded cups, makes for a wide range of putting experiences. Of course, since the putting surface 38 is easily removed from the upper surface of the the pan 30, this can be replaced or supplemented with different carpeting materials to simulate a wide range of putting, chipping and driving conditions.

In use, a golfer stands near the open end of the booth and drives the golf ball against the far net wall. Clearly this would be a more satisfying experience if a target or goal were provided so that the user could visualize the intended stroke, and could gauge the users success in placing the ball along the imagined fairway. A simple paper target could suffice. Such could be clipped or pinned at an opportune location on the far net wall. More complex target systems could be employed, including sophisticated computer trajectory and impact detecting systems outlined earlier. However, a simple expedient of a plastically deformable polymer foam slab 50 can fulfill most of the functions of the considerably more expensive electronic systems.

The slab 50 consists of a uniform thickness (in the range of about ⅛" to about 6" thick), of a closed cell polyurethane foam. This foam is of a known type, similar to that which can be used to form cushioning slabs for fighter pilot ejection seats. The main characteristic of the chosen foam material is that it yields on impact (as all such flexible foam materials would do) but the yielding foam does not immediately spring back to its original uncompressed state. On the contrary, the impact "crater" remains for some minutes before slowly becoming more and more shallow and finally becoming undetectable. This phenomenon makes the selected foam plastic material a superior target for the golf booth disclosed. First and foremost, the impact crater or indentation marks the location and its size suggests the velocity of impact. This alone would probably not be noteworthy, as any resilient material, and indeed the net booth walls themselves, would yield at the location and proportional to the force of impact of the ball. What is significant here is that the mark remains for the golfer to see many moments after the impact. Thus the user can concentrate on form and followthrough with full assurance that the mark on the slab will be there to assess the success of the drive after a comfortable interval. Indeed, if the user wished, a series of drives could be done, with a cluster of impact indentations showing whether there is a clustering or a wide random scattering. Eventually the craters would smooth out, thus renewing the target slab for more practice, but not before the user had evaluated the prior practice strokes. To obtain benefit from this, the preferred period of time during which the impression of the impact of the ball remains is between about 2 seconds and about 5 minutes before the impression substantially disappears.

Secondary to this impact marking, the plasticly deforming foam slab presents another opportunity to absorb the energy of the driven golf ball. Indeed, a true, resilient foam rubber pad, if firmly held on the far wall 22, may indeed cause the ball to rebound with some force, which is unacceptable and opposite to the overall impact absorbing nature of the suspended net impact dissipating structure of the booth. Preferably, the front surface of the slab 50 has a layer of abrasion resistant stretch fabric 52 with a golf scene and range marks printed on it to protect the relatively easily abrades foam from permanent damage and help more precisely estimate the distance the ball would have gone.

To store the practice booth when not being used, the motor is operated to rotate the axle 42. The cables 44 wrap around the axle. As they pass through the sheaves 46, they pull the pan 30 towards the ceiling. The pan moves upward, and the net walls 22 accumulate in folds or bunches along the sides and back edges of the the pan, captured between the lip portion 32 and the cables 44. The motor continues the hoisting operation until all portions of the booth are neatly tucked close to the ceiling panel 26. An automatic stop mechanism of the conventional type can be used to turn off the motor 45 when the pan has reached its maximum height. Of course the target 50 and other equipment associated with the booth can be stored by merely unfastening it from its hanging position on the target wall 22 and laying it flat on the carpet covered surface of the pan.

Although these descriptions contain many specifics, these should not be interpreted as limiting the scope of the invention but as merely providing illustrations of the preferred embodiments.

We claim:

1. An indoor practice booth for the game of golf and similar games employing a ball comprising a series of suspended walls, the walls include a target wall and flanking walls rising generally vertically above a supporting floor, a movable pan normally supported by the supporting floor and having an upper surface capable of receiving the ball, the upper surface extending between and beneath the walls and having means for embracing lower edges of the walls, and means for removing the movable pan from the supporting floor, wherein the means for removing the pan from the supporting floor comprise a series of generally vertical cables extending from an overhead support to attachment points at a peripheral edge of the pan, and means for pulling on the cables to thereby hoist the pan upward by the cables.

2. The indoor practice booth as set forth in claim 1 wherein the attachment points are positioned near but outside the area between the walls, whereby the cables constrain the walls as the pan is hoisted upward.

3. The indoor practice booth as set forth in claim 1 wherein the pan comprises a series of interlocking panels, a pair of such panels spanning a width dimension of the booth from edge to edge, and means for interlocking the pair of panels to create a generally stiff pan section.

4. The indoor practice booth as set forth in claim 1 wherein means for embracing the walls with the pan comprising an upwardly angled lip along an outer edge of the pan.

5. The indoor practice booth as set forth in claim 4 wherein the walls comprise netting the netting being suspended at an upper edge thereof from the overhead support, the angled lid being positioned to hold the netting as it gathers on the pan when the the pan is raised from the supporting floor.

6. An indoor practice booth for the game of golf and similar games employing a ball comprising, a series of suspended walls, the walls include a target wall and flanking walls rising generally vertically above a supporting floor, each of the walls having lower edges, a movable pan normally supported directly on the supporting floor and having an upper surface capable of receiving the ball, the upper surface extending between the walls and extending beneath the lower edges of the walls and supporting the lower edges of the flanking and target walls, means independent of the movable floor for suspending the walls in a generally vertical orientation above the supporting floor, and means for removing the movable pan from the supporting floor wherein the means for suspending the walls is a track attached to the lower surface of a ceiling of a structure surrounding the practice booth.

* * * * *